US005199234A

United States Patent [19]

Guhl

[11] Patent Number: 5,199,234

[45] Date of Patent: Apr. 6, 1993

[54] SKYLIGHT ASSEMBLY

[75] Inventor: James C. Guhl, Hudson, Wis.

[73] Assignee: Andersen Corporation, Minn.

[21] Appl. No.: 638,831

[22] Filed: Jan. 8, 1991

[51] Int. Cl.[5] ..... E04B 7/18

[52] U.S. Cl. ..... 52/200; 52/72; 52/213; 52/397; 52/475; 52/656.5

[58] Field of Search ..... 52/200, 72, 656, 213, 52/397, 475

[56] References Cited

U.S. PATENT DOCUMENTS

| | | | |
|---|---|---|---|
| 3,417,522 | 12/1968 | Kiekhaefer . | |
| 3,434,250 | 1/1969 | Kiekhaefer | 52/200 |
| 3,455,073 | 7/1969 | Kiekhaefer . | |
| 4,073,097 | 2/1978 | Jentoft et al. . | |
| 4,123,883 | 11/1978 | Barber, Jr. et al. | 52/200 |
| 4,409,767 | 10/1983 | Jentoft et al. . | |
| 4,514,944 | 5/1985 | Doell | 52/200 |
| 4,520,604 | 6/1965 | Halsey et al. . | |
| 4,570,394 | 2/1986 | Jentoft et al. | 52/72 |
| 4,750,302 | 6/1988 | Bechtold . | |
| 4,757,655 | 7/1988 | Jentoft et al. . | |
| 4,776,141 | 10/1988 | Powell . | |
| 4,788,804 | 12/1988 | Haas . | |
| 4,823,525 | 4/1989 | Roberts et al. . | |

*Primary Examiner*—David A. Scherbel
*Assistant Examiner*—Wynn Wood
*Attorney, Agent, or Firm*—Merchant, Gould, Smith, Edell, Welter & Schmidt

[57] ABSTRACT

A skylight assembly includes pultruded fiberglass sash members (11-14) operatively connected by means of corner locks (20). A frame (35-36) is operatively connected to the sash member and the frame is operatively connected to a roof structure. A gasket (50) is operatively connected to the frame. The sash member has an attachment flange positioned proximate the inside surface of the frame, wherein the window and sash member of the skylight assembly may be replaced from the inside of the building. The sash member is a multifunctional sash member.

18 Claims, 5 Drawing Sheets

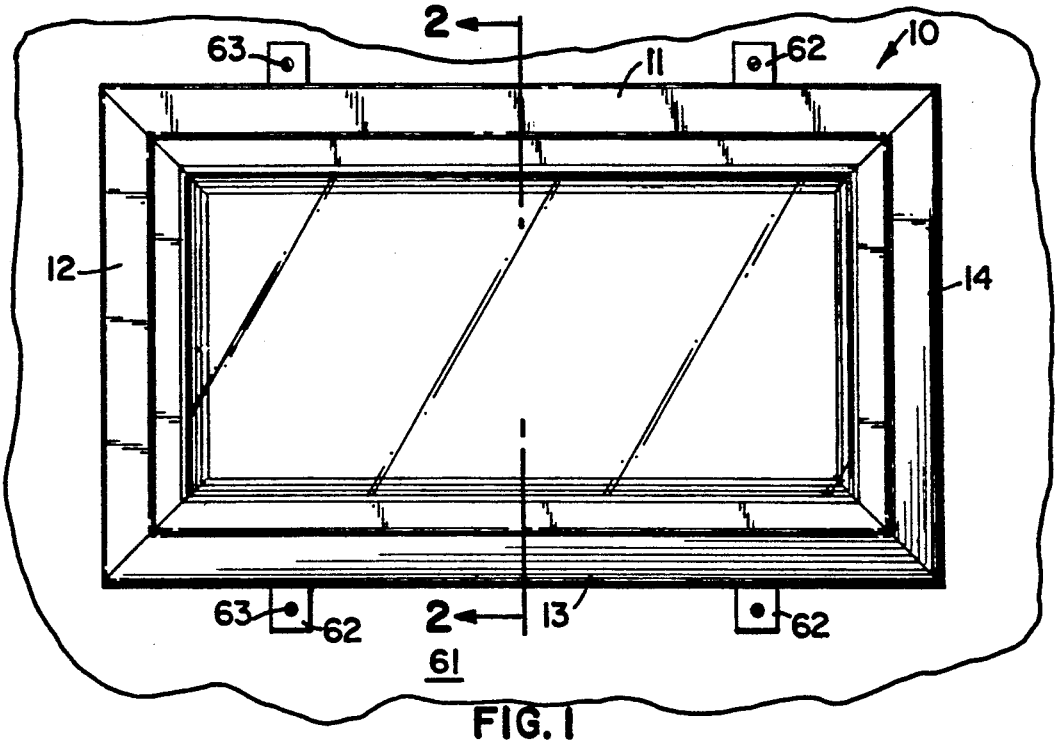
FIG. 1
FIG. 2
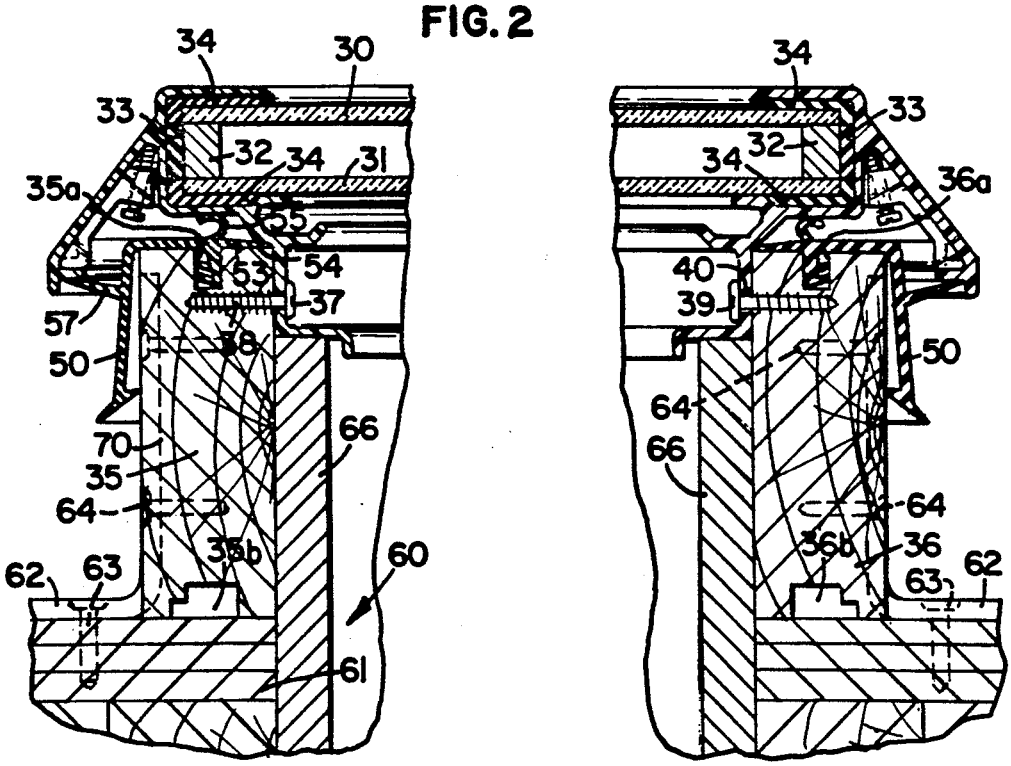

FIG. 6
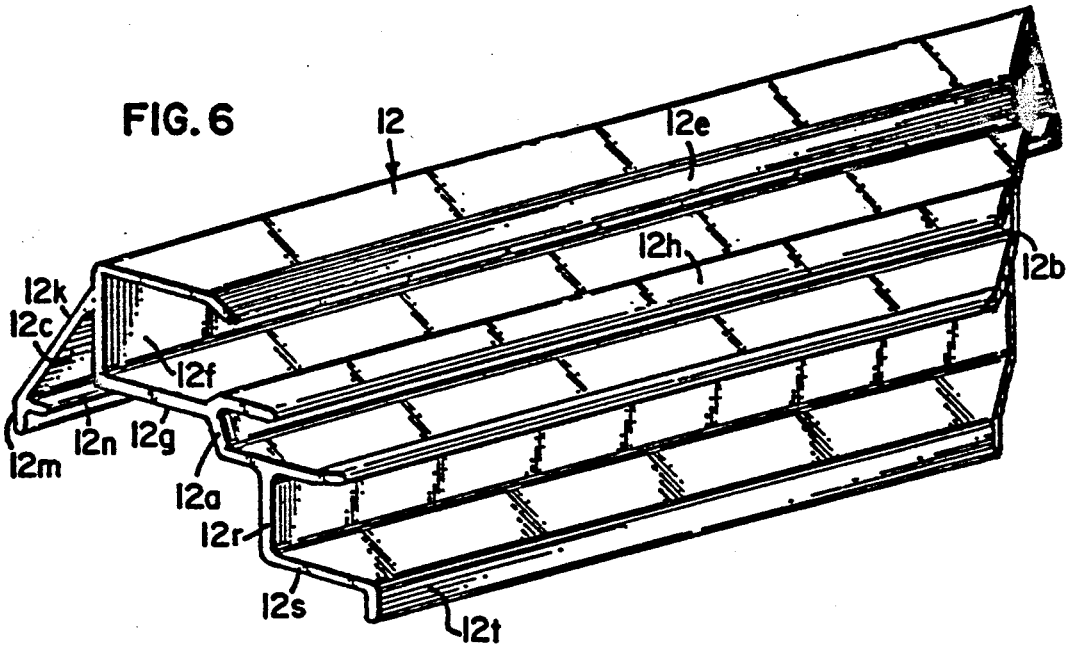
FIG. 7
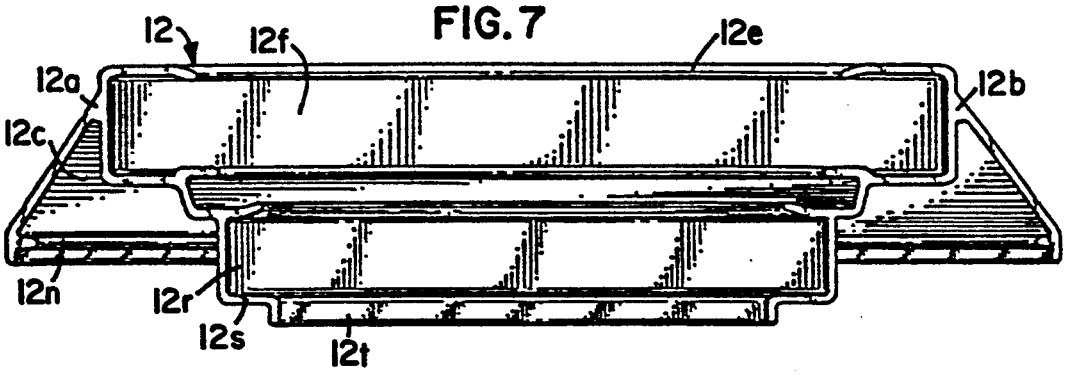
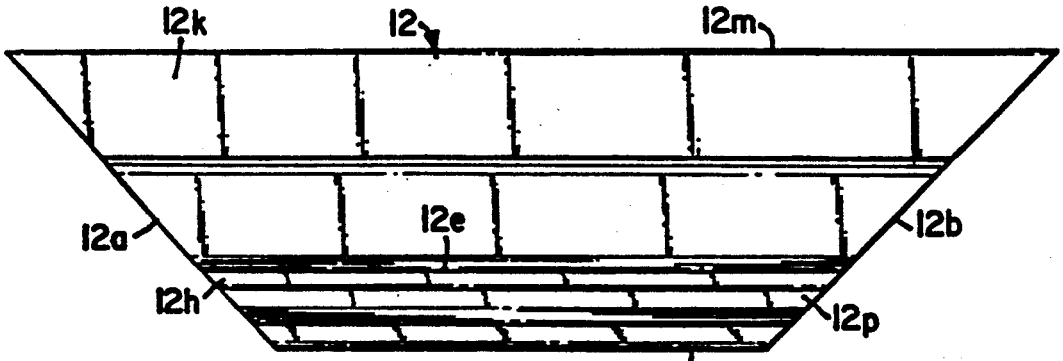
FIG. 8

SKYLIGHT ASSEMBLY

BACKGROUND OF THE INVENTION

1. Field of the Invention

This invention relates generally to a skylight assembly, and more particularly to a skylight assembly having a multi functional pultruded fiberglass sash member.

2. Description of the Prior Art

There are many examples in the prior art dealing with skylight technology of the various types and designs of skylight which have been adapted for different purposes and constructions. While there have been significant advances in skylight technology over their history, there are still several problems which have not been satisfactorily resolved.

When a skylight is initially installed, the construction workers are typically on both the inside and the outside of the house. Therefore, obtaining access to the roof is not a significant consideration. However, after installation, it is often necessary to replace a portion of the skylight due to damage to the skylight. The prior art skylights have, to Applicants' knowledge, all required the replacement work to be done at least partially on top of the roof. The present invention addresses this problem and provides for a replacement skylight which may be installed from inside of the building.

The "profile" of the skylight assembly is required to perform a number of functions. The present invention provides for a sash member which has a profile which performs a number of functions and the profile is formed from a single fiberglass pultrusion. The fiberglass pultrusion allows the sash member to have adequate structural and thermal characteristics.

The present invention addresses the problems associated with the prior art skylights and provides for an improved skylight assembly.

BRIEF DESCRIPTION OF THE DRAWINGS

FIG. 1 is a top plan view of a skylight assembly in accordance with the present invention.

FIG. 2 is a cross sectional view of the skylight assembly shown in FIG. 1, taken generally along the lines 2–2 and the entire view rotated 90°.

FIG. 6 is a perspective view of one pultruded fiberglass sash member of the skylight assembly shown in FIG. 1.

FIG. 7 is a front elevational view of the member of FIG. 6.

FIG. 8 is a top plan view of the member shown in FIG. 6.

SUMMARY OF THE INVENTION

Figure 3A:
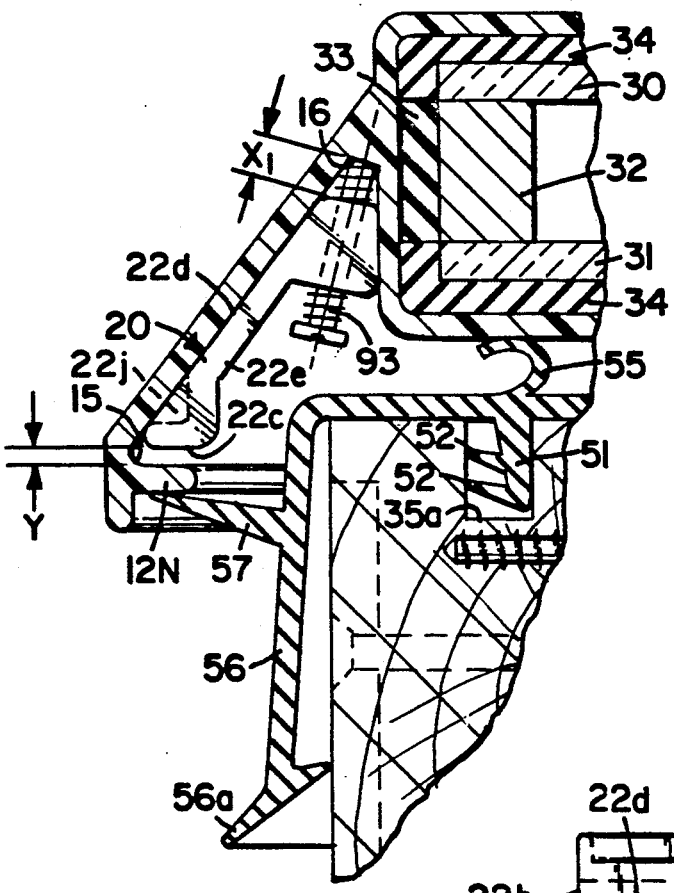
FIG. 3*a* is an enlarged cross sectional view of a portion of the skylight assembly shown in FIG. 2 when a corner lock is in an unengaged position.

The invention is a skylight assembly adapted to be mounted to cover an opening in a roof structure of a building. The assembly includes a glass unit, preferably a double pane glass unit, although other suitable transparent alternatives may be utilized. The glass unit is positioned in a sash member, which is preferably made of fiberglass and made by a pultrusion process. A frame is operatively connected to the sash member. Means for operatively connecting the frame to the roof structure is provided. A gasket is operatively connected to the frame and positioned between the frame and sash member, thereby forming a weatherstrip.

In a preferred embodiment, the frame has an inside surface and an outside surface. The sash member has an attachment flange positioned proximate the inside surface of the frame. Further, means for securing the attachment flange to the inside surface of the frame is provided, wherein the glass unit may be replaced from inside of the building by removal of the securing means, whereby the sash member and glass unit may be removed and replaced.

Still further, in a preferred embodiment, the sash member has a drywall (or other interior finish trim material) return member, whereby a sheet of drywall may be positioned under the drywall return member. Also, the frame member may have a drywall opening in its bottom member to provide an alternate means of installation for the skylight assembly. The glass unit preferably has a glass spacer recessed in the sash member, wherein the spacer is positioned to reduce thermal conductivity, thereby reducing condensation. The gasket preferably provides three points of weather sealing.

DETAILED DESCRIPTION OF THE PREFERRED EMBODIMENT

Referring to the drawings, wherein like numerals represent like parts throughout the several views, there is generally disclosed at 10 a skylight assembly in FIG. 1. For a typical installation, the assembly 10 would be rotated 90°. The skylight of the assembly 10 includes four pultruded fiberglass sash member 11, 12, 13 and 14 operatively connected by means of four corner locks, generally designated at 20. The pultruded fiberglass sash members 11–14 are substantially the same except for the length of the pultruded fiberglass sash members. FIGS. 6–11 show a detailed view of one of the pultruded fiberglass sash members 12 and will be discussed in detail, realizing that the other pultruded fiberglass sash members 11, 13 and 14 are similar. The pultruded fiberglass sash member 12 has a first mitred end 12*a* and a second mitred end 12*b*. As can be best seen in FIG. 8, the mitre is at 45°. Therefore, when two pultruded fiberglass sash members are connected, a 90° corner is formed. However, it is understood other angles could also be formed.

Figure 9:
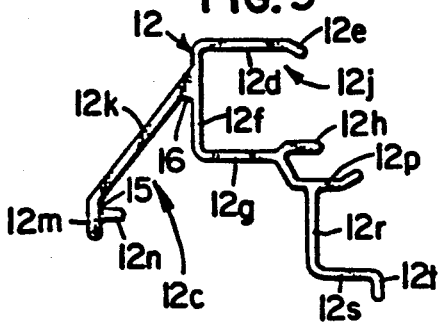
FIG. 9 is a left side elevational view of the member shown in FIG. 6, the right side elevational view being a mirror image thereof.
Figure 10:
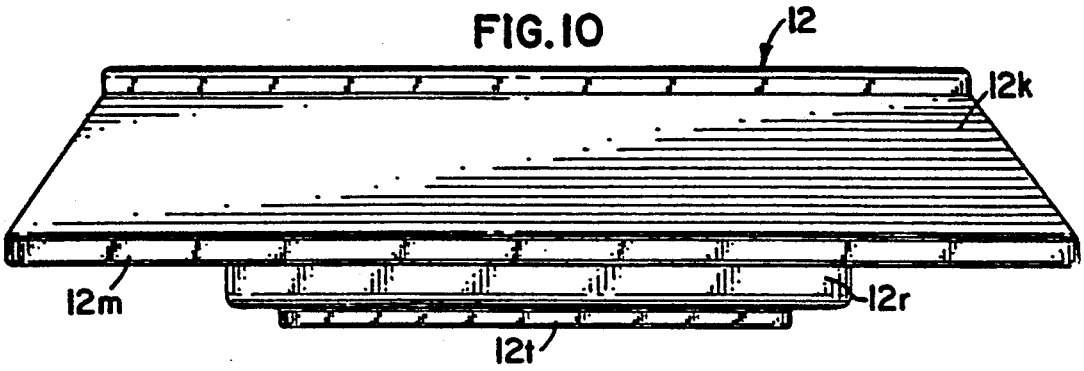
FIG. 10 is a rear elevational view of the member shown in FIG. 6.
Figure 11:
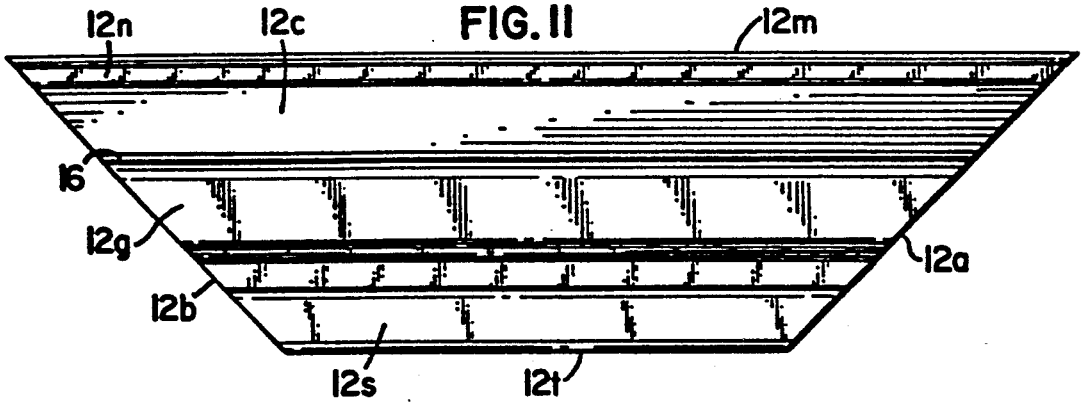
FIG. 11 is a bottom plan view of the member shown in FIG. 6.

Referring to FIGS. 6–11 and more particularly to FIG. 9, it can be seen that the pultruded fiberglass sash member 12 has an opening and forms channel cavity 12*c*. The pultruded fiberglass sash member 12 is a single, unitary piece and is formed by a pultrusion process and is formed of fiberglass. The fiberglass construction gives both the necessary structural and thermal properties which are advantageous for a skylight sash member. A plastic or PVC frame would not have the necessary structural strength and a metal, such as aluminum, would not have the necessary thermal properties. The fiberglass, or glass reinforced polyester, has a longitudinal modulus of 65,000 psi and a transverse modulus of 10,200 psi. The thermal conductivity is 4.5 btu/ft$^2$/hr./°F./inch. This is compared to the characteristics of PVC which is also not as weatherable or dimensionally stable as pultruded fiberglass. PVC has a tensile strength in both the longitudinal and transverse direction of 6,500 psi and a thermal conductivity of 1.2 btu/ft$^2$/hr./°F./inch. It can be seen that while the thermal characteristics are acceptable, the tensile strength is not acceptable. The properties of 6063-tg aluminum do have an acceptable tensile strength of 30,000 psi, but an unacceptable thermal conductivity of 1,200 btu/ft$^2$/hr./°F./inch. It can therefore be seen that the fiberglass pultrusion has the advantages of structural strength and low thermal conductivity. Still further, the fiberglass pultrusion is very weatherable. This combination allows for the use of a single profile concept, extending from the inside to the outside without getting excessive heat loss and frost on the inside. Further advantages of a pultrusion fiberglass sash member over molded fiberglass are that the pultrusion is more cost effective and it is also easier to control the dimensions of the profile during manufacture. The frame 12 comprises a top member 12*d* having a downwardly depending tip 12*e*. A side member 12*f* has a first end operatively connected to the top member 12*d* and a second end operatively connected to a bottom member 12*g*. The bottom member 12*g* has a flange 12*h* which is generally parallel to the bottom member 12*g* but is slightly offset therefrom The top member 12*d*, tip 12*e*, side 12*f*, bottom member 12*g* and flange 12*h* form a generally C-shaped member which has a cavity 12*j* into which the double pane of glass is positioned. A watershed member 12*k* is operatively connected to the side 12*f* and depends generally outward and downward from the side 12*f*. The watershed member 12*k* has a tip 12*m* at the end opposite the connection to the side 12*f*. The tip 12*m* has an inward protrusion 12*n* which, with the watershed member 12*k*, forms a first corner surface designated as 15. The watershed 12*k* and the side member 12*f* form a second corner surface designated as 16. A condensation channel is formed by channel member 12*p* which has a first end operatively connected to the bottom member 12*g*, a middle section, and an upwardly extending second end. The channel 12*p* is positioned generally inward from the end of the flange 12*h* to collect any condensation which may form on the glass which would drip into the channel 12*p*. An attachment flange 12*r* is operatively connected to the condensation channel 12*p* and extends generally downward therefrom. A drywall return 12*s* is operatively connected to the bottom of the attachment flange 12*r*. The return 12*s* has a downwardly depending lip 12*t*.

FIG. 1 shows the four pultruded fiberglass sash members 11, 12, 13 and 14 operatively connected by corner locks 20, as will be explained more fully hereinafter. Referring now to FIG. 2, a first pane of glass 30 and a second pane of glass 31 are positioned in the cavity 12*j* formed in pultruded fiberglass sash member 12 as well as similar cavities formed in the other pultruded fiberglass sash members 11, 13 and 14. Aluminum glass spacers 32 are positioned around the perimeter of the panes 30 and 31. Foam members 33 are positioned between the spacers 32 and the sides of the pultruded fiberglass sash members for example 12*f*. A silicon glaze 34 is then dispensed between the pane 30 and the top members of the pultruded fiberglass sash members, i.e. 12*d*, and also between the pane 31 and the bottom members of the pultruded fiberglass sash members, i.e. 12*g*. The aluminum glass spacers 32 are not positioned over the flanges of the sash members, i.e. 12*h*, but are instead recessed and are positioned so that the spacers 32 are as far away as possible from the glass that is exposed to room air. The glass which is exposed to room air is the glass between the flanges 12*h*. By recessing the glass spacer 32 in the cavity of the sash members, i.e. 12*j*, the thermal transfer is reduced and therefore results in less condensation being formed on the glass. The glass 30, glass 31, spacers 32, foam members 33 and glaze 34 form what is referred to as a glass unit. However, it is understood other suitable substitutes may be utilized such as a single pane of glass, triple pane of glass or plastic for the glass.

The pultruded fiberglass sash members 11–14 are operatively connected to a frame, as best shown in FIG. 2. Two members of the frame are shown in FIG. 2, but it is of course recognized by one skilled in the art there are two additional frame members which would be under pultruded fiberglass sash members 11 and 13 to form a rectangular shape which would of course match the shape of the connected pultruded fiberglass sash member. Frame member 35 is operatively connected to the pultruded fiberglass sash member 14 and frame member 36 is operatively connected to the pultruded fiberglass sash member 12. The pultruded fiberglass sash members 11–14 have an opening in the attachment flange through which a screw is inserted into the frame member. As shown in FIG. 2, a screw 37 is inserted through an opening 38 in the attachment flange 12*r* of the pultruded fiberglass sash member 12. The screw 37 secures the pultruded fiberglass sash member 14 to the frame 35. Similarly, screw 39 is inserted through an opening 40 in the attachment flange of pultruded fiberglass sash member 14 into the frame member 36.

During assembly, prior to the assembly of the sash members 11–14 to the frame, a gasket 50 is secured to the frame. The four frame members are generally rectangular in cross section but have a notch 35*a* and 36*a* cut out at the top and a sheetrock return notch 35*b* and 36*b* cut out at the bottom. The frame members under pultruded fiberglass sash members 11 and 13 have similar notches and accordingly, there is a continuous notch which runs around the top of the frame members as well as the bottom of the frame members. A continuous gasket or weatherstrip 50 is made of EPDM (ethylene propylene diene monomer) rubber or other suitable material. The cross section of the gasket 50 is seen most clearly in FIGS. 2, 3*a* and 3*b*. An attachment member 51 is sized to form a friction fit with the notch 35*a*. The attachment member 51 has deformable protrusions 52 which allow for the attachment member 51 to be inserted into the notch 35*a* more easily but still resist being removed. A top member 53 is connected to the attachment member 52 and is configured to lay on the top of the frame members. The top member 53 has a tip 54 which contacts the bottom on the condensation channel of the pultruded fiberglass sash members. A primary weather seal extension 55 is operatively connected to the top member 53 and is positioned just above the attachment member 51. The extension member 55 is curved and is deformed downward when the bottom member, i.e. 12*g*, contacts it. A downwardly extending flashing engagement member 56 is operatively connected to the top member 53. The flashing engagement member 56 has an angled engagement member 56a for engaging the flashing, which will be described more fully hereafter. A secondary weatherstrip extension 57 is operatively connected to the flashing engagement member 56 and extends outward and slightly upward for engagement underneath the protrusion of the sash members, i.e. 12n. The tip 54 is the third point of weatherstrip protection. The gasket 50 is preferably formed of one piece and is injected molded at the corners to form a single piece rectangular gasket.

The frame is operatively connected to cover an opening 60 in a roof structure 61. 90° angle brackets 62 have a first leg which is operatively connected to the roof structure 61 by means of screws 63 and a second leg which is operatively connected to the frame members, i.e. 35 and 36, by means of screws 64. A recess 70 is formed in the frame members, i.e. 35 and 36, so that the second leg of the angle bracket 62 does not extend beyond the frame member itself. This provides for a flush mounting of the angle bracket so that it does not protrude from the frame members, i.e. 35 and 36. During installation, flashing (not shown) is positioned along the outside surface of the frame members, i.e. 35 and 36, underneath the flashing engagement member 56.

Figure 5:
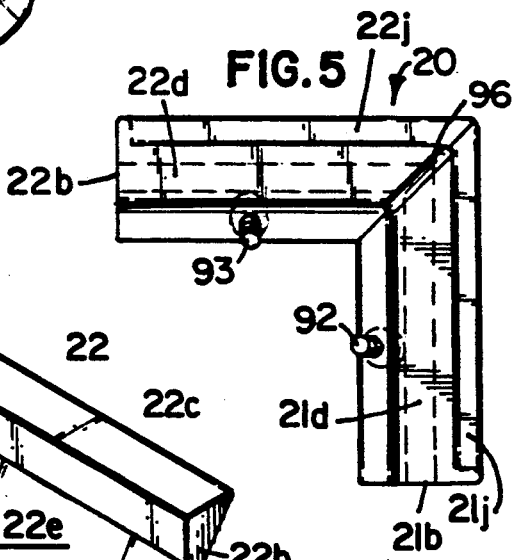
FIG. 5 is a bottom plan view of the corner lock shown in FIG. 4.
Figure 4:
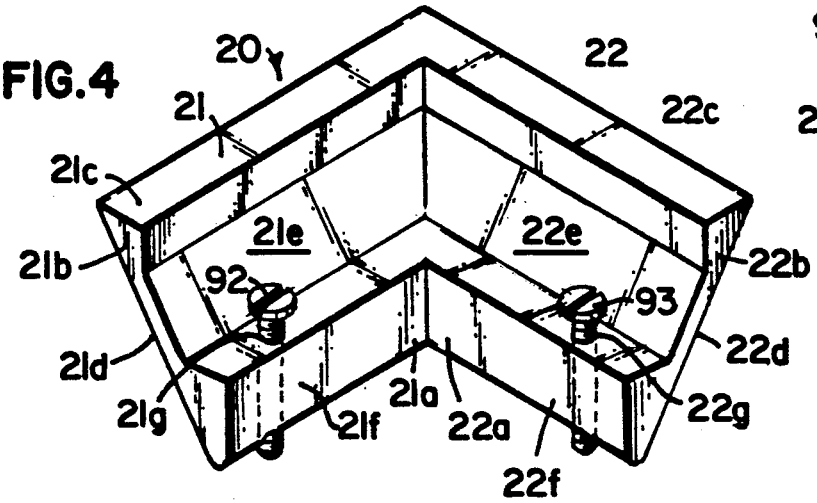
FIG. 4 is a perspective view of a corner lock utilized in connecting the skylight assembly.
Figure 3B:
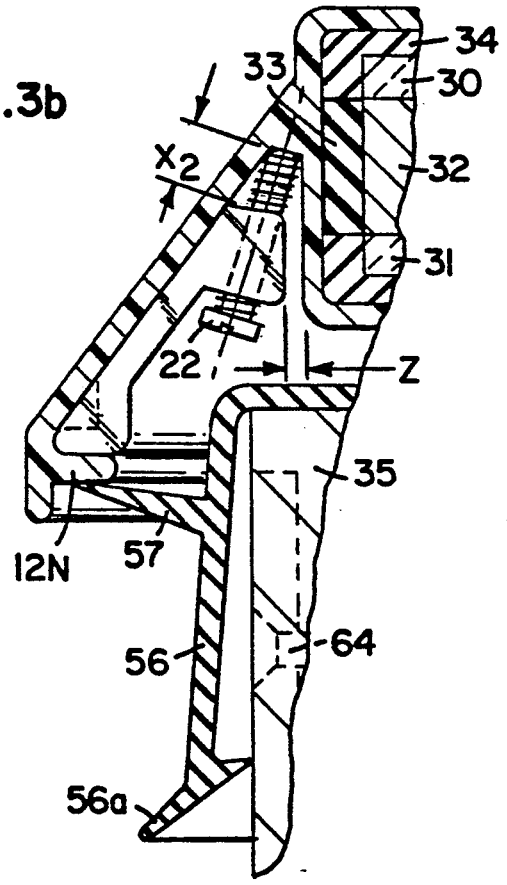
FIG. 3*b* is an enlarged cross sectional view of a portion of the skylight assembly shown in FIG. 2 when a corner lock is in an engaged position.

The corner locks 20, which are used to secure the pultruded fiberglass sash members together are shown in FIGS. 4 and 5. FIGS. 3a and 3b show the corner lock in two of its positions. Preferably, the corner lock is formed from a single unitary piece of plastic. As can be seen clearly in FIG. 5, the corner lock 20 forms a 90° angle. This would of course be dependent upon the angle formed by the pultruded fiberglass sash members 11–14. For the majority of windows, these would be 90°, but it is also possible to have other angles. The corner lock 20 has a first leg 21 having a first end 21a and a second end 21b. A second leg 22 similarly has a first end 22a and a second end 22b. The first ends 21a and 22a are operatively connected to each other at an intersection, and preferably are formed of a single unitary piece.

Each leg member has a first planar surface 21c, 22c. As will be discussed more fully hereafter, the first planar surface, 21c or 22c, is adapted to engage the top surface of the protrusion 12n and generally conforms in shape for mating acceptance to the first corner surface 15. The back surface 21d of section 21e is positioned against the inside surface of the watershed 12k. The bottom section 21f has a threaded aperture 21g through which a threaded screw 92 is inserted. The back surface 22d of section 22e is positioned against the watershed of the pultruded fiberglass sash member. The bottom section 22f has a threaded aperture 22g through which a threaded screw 93 is inserted. The bottom sections 21f and 22f each have an elongate cutout at 21j, 22j. Similar cutouts (not shown) may be positioned proximate the screws 92 and 93. The purpose of the cutouts is to maintain a more uniform wall thickness so that the cycle time in manufacturing is lower. The shape of the leg member 21 generally conforms to a portion of the cavity 12c. Similarly, the second leg 22 conforms in shape to a comparable cavity in the adjacent pultruded fiberglass sash member. A groove 96 is formed at the intersection of the leg members 21 and 22. The groove 96 is adjacent the pultruded fiberglass sash member intersection. The four pultruded fiberglass sash members are sealed with a silicone sealant. If there are burrs at the mitred ends of the sash members, the groove 96 provides a place for the burrs to be positioned so when the corner locks are tightened the burrs do not force open the mitre.

The operation of the corner lock 20 is best seen in FIGS. 3a and 3b which show the sequence of assembly. It should be recognized that while FIG. 3a is consistent with the orientation of the skylight assembly shown in FIGS. 1 and 2, to represent the process during assembly FIGS. 3a and 3b should be turned upside down. The corner lock 20 is sized slightly smaller than the cavities formed by the pultruded fiberglass sash members i.e. 12j so that the second leg may be slid into one of the cavities and the first leg being slid into the similar cavity of the adjacent pultruded fiberglass sash member. Since the corner lock 20 is slightly smaller than the cavities, there is not a friction fit between the corner lock and the cavities of the pultruded fiberglass sash members Keeping in mind that FIG. 3a should be rotated 180°, gravity will tend to force corner lock 20 into the bottom section 12f and is then a distance $X_1$ from the second corner 16. Further, the first planar surface 22c is at a distance Y from the protrusion 12n. Finally, the bottom section 22f is also flush against the outside surface of the side 12f. In this position, the corner lock 20 is not engaged and is not securing the pultruded fiberglass sash members to each other.

Then, the screw 93 is rotated clockwise so as to advance the screw through the threaded aperture 22g. This wedges the first planar surface 22c against the protrusion 12n and locks the second leg 22 into the cavity 12j of the pultruded fiberglass sash member 12. Similarly, the first leg 21 would be tightened into the adjacent pultruded fiberglass sash member 11 by rotating screw 92. As can be seen in FIG. 3b, the distance $X_1$ is now greater because the corner lock 20 has been wedged against the protrusion 12n to lock the pultruded fiberglass sash members into position. The corner lock has moved away from the side 12f by a distance Z. The corner lock 20 provides for a corner lock that is easy to use in a manner that does not require holes or apertures through the pultruded fiberglass sash members.

In assembling the pultruded fiberglass sash members 11–14 four corner locks 20 are utilized. The pultruded fiberglass sash members, as previously stated, have an opening and channel cavity at their mitered ends. The corner locks are sized to be placed in the channel cavities of adjacent pultruded fiberglass sash members. The first leg of the corner lock is in one cavity and the second leg is in the adjacent cavity.

The fastening members or screws 92 and 93 are tightened and the fastening members engage the first corner surfaces and move both the leg members against the second corner surfaces, thereby tightening and securing the pultruded fiberglass sash members together without the necessity of holes being formed in the pultruded fiberglass sash members 11–14. Therefore, no unsightly holes are seen in the outside of the sash members. The screws are of a harder material than the pultruded fiberglass sash members. Therefore, upon still further tightening, the screws 92 and 93 penetrate the pultruded fiberglass sash members to further lock the pultruded fiberglass sash members in relative position to one another.

When the skylight assembly 10 is secured to the roof structure 61 to cover the opening 60, the window unit, sash members and frame are all one unit. The skylight assembly 10 is then secured by means of screws 63 through the bracket 62 and into the roof 61. The bracket 62 is then secured into the recess 70 of the frame by means of screws 64. As shown in FIG. 4, the drywall 66 is positioned adjacent the frame 35 and 36 and is located underneath the drywall return 12*s*. It is understood that other suitable interior finish material may be used instead of drywall The lip 12*t* comes down past the drywall 66 and provides for an aesthetically pleasing finish, even if the top of the drywall 66 is jagged. The frame 35 and 36 also have a notch 35*b* and 36*b* which may be utilized for alternately positioning drywall. While not shown, it is easily understood how the frame 35 and 36, if closer together, would extend such that the notches 35*b* and 36*b* would extend inside of the roof opening 60 such that the drywall 66 could be positioned inside of the notch 35*b* and 36*b*. The installer therefore has two options as to how to finish off the skylight assembly with drywall. If it is necessary to replace the glass unit and/or sash members after initial installation, it is possible to do so from inside the building. Screws 37 and 39 are removed from the frame 35 and 36. Then the entire sash (glass unit and sash members) may be removed and replaced.

The simplicity of the single profile sash member construction is very advantageous. Having one profile that performs all of the functions of watershed, glass enclosure, weatherseal, condensation channel, attachment flange and sheetrock return is a great advantage over having a number of separate parts and pieces fastened together to perform these functions. By so doing, manufacturing complexity is significantly reduced and tolerance problems caused by fitting parts together is eliminated. Further, the unsightly appearance caused by using numerous parts and fasteners is eliminated. The leakage and other performance problems caused by fastening many parts together instead of using one homogeneous piece are similarly avoided.

Other modifications of the invention will be apparent to those skilled in the art in light of the foregoing description. This description is intended to provide specific examples of individual embodiments which clearly disclose the present invention. Accordingly, the invention is not limited to these embodiments or the use of elements having specific configurations and shapes as presented herein. All alternative modifications and variations of the present invention which follow in the spirit and broad scope of the appended claims are included.

We claim:

1. A skylight assembly adapted to be mounted to cover an opening in a roof structure of a building, comprising:

(a) a glass unit;

(b) a fiberglass sash member, said window unit positioned in said sash member;

(c) a frame operatively connected to said sash member, said frame comprising:

(i) said frame having an inside surface and an outside surface;

(ii) said sash member having an attachment flange positioned proximate said inside surface; and (iii) means for securing said attachment flange to only said inside surface, wherein said glass unit may be replaced from inside of the building by removal of said securing means, whereby said sash member and glass unit may be removed and replaced;

(d) means for operatively connecting said frame to the roof structure; and (e) a gasket operatively connected to said frame and positioned between said frame and said sash member forming a weatherstrip.

2. The assembly of claim 1, wherein said sash member comprises:

(a) a generally C-shaped support member for holding said glass unit;

(b) a watershed member extending generally outward and downward from said support member; and (c) a condensation channel operatively connected to said support member.

3. The assembly of claim 2, wherein said sash member further comprises a drywall return member whereby a sheet of drywall may be positioned under said drywall return member.

4. The assembly of claim 3, wherein said sash member has an inner cavity suitable to be joined to an adjacent sash member by means of a corner lock.

5. The assembly of claim 1, wherein said frame comprises:

(a) a generally rectangular member having inside, outside, top and bottom surfaces; and (b) said top surface having an opening for receiving said gasket by means of a friction fit.

6. The assembly of claim 5 further comprising:

(a) said operatively connecting means including an angle brace; and (b) said frame having a recess in said outer surface in which said brace is positioned.

7. The assembly of claim 4, wherein said glass unit comprises:

(a) first and second glass members positioned in said C-shaped support member; and (b) a glass spacer recessed in said sash member, wherein said spacer is positioned to reduce thermal conductivity, thereby reducing condensation.

8. The assembly of claim 7, further comprising sealant positioned between said C-shaped support member and said first and second glass members.

9. The assembly of claim 2, wherein said gasket provides three points of weather sealing, a first point under said C-shaped member, a second point between said frame and condensation channel and a third point proximate said watershed member.

10. A skylight assembly adapted to be mounted to cover an opening in a roof structure of a building, comprising:

(a) a glass unit;

(b) a single unitary fiberglass sash member, said glass unit positioned in said sash member;

(c) a frame operatively connected to said sash member, said frame having an inside surface and an outside surface;

(d) means for operatively connecting said frame to the roof structure;

(e) said single unitary sash member comprises:

(i) a generally C-shaped support member for holding said glass unit;

(ii) a watershed member extending generally outward and downward from said support member;

(iii) a condensation channel operatively connected to said support member;

(iv) a drywall return member whereby a sheet of drywall may be positioned under said drywall return member; and (v) an attachment flange position proximately said inside surface;

(f) means for securing said attachment flange to said inside surface; and (g) a gasket operatively connected to said frame and positioned between said frame and said sash member forming a weatherstrip wherein said gasket provides three points of weather sealing, a first point under said C-shaped member, a second point between said frame and said condensation channel, and a third point proximate said watershed member.

11. The assembly of claim 10, wherein said sash member has an inner cavity suitable to be joined to an adjacent sash member by means of a corner lock.

12. The assembly of claim 10, wherein said frame comprises:

(a) a generally rectangular member having inside, outside, top and bottom surfaces;

(b) said top surface having an opening for receiving said gasket by means of a friction fit.

13. The assembly of claim 12 further comprising:

(a) said operatively connecting means including an angle brace; and (b) said frame having a recess in said outer surface in which said brace is positioned.

14. The assembly of claim 10, wherein said glass unit comprises:

(a) first and second glass members positioned in said C-shaped support member; and (b) a glass spacer recessed in said sash member, wherein said spacer is positioned to reduce thermal conductivity, thereby reducing condensation.

15. The assembly of claim 14, further comprising sealant positioned between said C-shaped support member and said first and second glass members.

16. A skylight assembly adapted to be mounted to cover an opening in a roof structure of a building, comprising:

(a) a glass unit;

(b) a single unitary fiberglass sash member, said glass unit positioned in said sash member, said sash member comprises:

(i) a generally C-shaped support member for holding said glass unit;

(ii) a watershed member extending generally outward and downward from said support member; and (iii) a condensation channel operatively connected to said support member;

(iv) said sash member further comprises a drywall return member whereby a sheet of drywall may be positioned under said drywall return member; and (v) said sash member has an inner cavity suitable to be joined to an adjacent sash member by means of a corner lock;

(c) a frame operatively connected to said sash member, said frame comprises:

(i) a generally rectangular member having inside, outside, top and bottom surfaces; and (ii) said top surface having an opening for receiving said gasket by means of a friction fit;

(d) means for operatively connecting said frame to the roof structure;

(e) a gasket operatively connected to said frame and positioned between said frame and said sash member forming a weatherstrip, said gasket provides three points of weather sealing, a first point under said C-shaped member, a second point between said frame and condensation channel and a third point proximate said watershed member;

(f) said sash member having an attachment flange positioned proximate said inside surface;

(g) means for securing said attachment flange to only said inside surface, wherein said glass unit may be replaced from inside of the building by removal of said securing means, whereby said sash and glass unit may be removed and replaced; and (h) said glass unit comprises:

(i) first and second glass members positioned in said C-shaped support member; and (ii) a glass spacer recessed in said sash member, wherein said spacer is positioned to reduce thermal conductivity, thereby reducing condensation.

17. The assembly of claim 16 further comprising:

(a) said operatively connecting means including an angle brace; and (b) said frame having a recess in said outer surface in which said brace is positioned.

18. The assembly of claim 16, further comprising sealant positioned between said C-shaped support member and said first and second glass members.

* * * * *

UNITED STATES PATENT AND TRADEMARK OFFICE

CERTIFICATE OF CORRECTION

PATENT NO. : 5,199,234

DATED : April 6, 1993

INVENTOR(S) : James C. Guhl

It is certified that error appears in the above-identified patent and that said Letters Patent is hereby corrected as shown below:

Column 3, Line 33, insert --.-- after the word "therefrom".

Column 6, Line 34, "$X_1$" should read --$X_2$--.

Signed and Sealed this

Twenty-eighth Day of December, 1993

Attest:

Bruce Lehman

BRUCE LEHMAN

Attesting Officer

Commissioner of Patents and Trademarks